US007717234B2

(12) United States Patent
Mizuno et al.

(10) Patent No.: US 7,717,234 B2
(45) Date of Patent: May 18, 2010

(54) LUBRICATING DEVICE OF INTERNAL COMBUSTION ENGINE

(75) Inventors: Kinya Mizuno, Saitama (JP); Hiromi Sumi, Saitama (JP); Ken Oike, Saitama (JP); Seiji Hamaoka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 239 days.

(21) Appl. No.: 11/889,846

(22) Filed: Aug. 16, 2007

(65) Prior Publication Data

US 2008/0078619 A1 Apr. 3, 2008

(30) Foreign Application Priority Data

Aug. 21, 2006 (JP) ..... 2006-224637

(51) Int. Cl.

| | |
|---|---|
| ***F01M 1/04*** | (2006.01) |
| *F01M 1/02* | (2006.01) |
| *F01M 1/06* | (2006.01) |
| *F01M 11/00* | (2006.01) |

(52) U.S. Cl. ..... 184/6.5; 184/6.28; 123/196 R; 123/572

(58) Field of Classification Search ..... 184/6.5; 123/196 R, 196 A, 573, 41.86, 196 N
See application file for complete search history.

(56) References Cited

U.S. PATENT DOCUMENTS

| | | | | |
|---|---|---|---|---|
| 6,305,342 | B1 * | 10/2001 | Narita et al. | 123/196 R |
| 6,318,333 | B1 * | 11/2001 | Narita et al. | 123/196 R |
| 6,763,814 | B2 * | 7/2004 | Gokan | 123/572 |

FOREIGN PATENT DOCUMENTS

| | | | |
|---|---|---|---|
| JP | 2004-108257 A | | 4/2004 |
| JP | 2004108236 A | * | 4/2004 |

* cited by examiner

*Primary Examiner*—Robert A Siconolfi
*Assistant Examiner*—San Aung
(74) *Attorney, Agent, or Firm*—Birch, Stewart, Kolasch & Birch, LLP

(57) ABSTRACT

A lubricating device for an internal combustion engine includes an oil tank chamber defined by being separated from a crank chamber by a partition wall that is formed between a crankcase and a crankcase cover of the internal combustion engine. Oil pumped by a scavenge pump is supplied to a tank supply port which is open at an upper portion of the oil tank chamber to the oil tank chamber. The oil stored in the oil tank chamber is sucked from a feed suction port which is open at a lower portion of the oil tank chamber to be supplied to respective regions for lubrication of the internal combustion engine by a feed pump. An oil passage penetrating inside the oil tank chamber is formed below the tank supply port at an upper portion of the oil tank chamber.

20 Claims, 8 Drawing Sheets

LUBRICATING DEVICE OF INTERNAL COMBUSTION ENGINE

CROSS-REFERENCE TO RELATED APPLICATIONS

The present application claims priority under 35 USC 119 to Japanese Patent Application No. 2006-224637 filed on Aug. 21, 2006 the entire contents of which are hereby incorporated by reference.

BACKGROUND OF THE INVENTION

1. Field of the Invention

The present invention relates to a dry sump lubricating device for an internal combustion engine.

2. Description of Background Art

An internal combustion engine having a dry sump lubricating device includes an oil tank for storing oil pumped by a scavenge pump. The oil tank is generally configured by being defined in a crankcase, or is configured between a crankcase and a crankcase cover, if the crankcase cover is provided. See, for example, JP-A No. 2004-108257.

The lubricating device disclosed in JP-A No. 2004-108257 is configured in such a manner that the oil pumped by the scavenge pump of a trochoid type is supplied to the oil tank from a supply port for the tank located nearest to a front case cover (crankcase cover) through an oil cooler. The oil stored in the oil tank is sucked from a suction port which is open at a lower portion of the oil tank by a feed pump of a trochoid type. In addition, the oil discharged from a discharge port of the feed pump is supplied to respective regions for lubrication of the internal combustion engine.

In the dry sump lubricating device, when the oil is supplied to the oil tank from the supply port for the tank by the scavenge pump, bubbles are mixed in the oil. Further, bubbles are also mixed in the oil sucked by the feed pump. Thus, there is a high possibility that the feed pump causes cavitation.

A hydraulic pressure of the oil to be supplied to the respective regions for lubrication is not stabilized due to the cavitation of the feed pump.

SUMMARY AND OBJECTS OF THE INVENTION

The present invention has been achieved in view of the foregoing. An object of an embodiment of the present invention is directed to providing a lubricating device of a power unit in which bubbles are prevented from being mixed in the oil sucked from an oil tank by a feed pump to reduce cavitation of the feed pump. Thus, hydraulic pressure of the oil to be supplied to respective regions for lubrication can be stabilized.

In order to achieve an object of an embodiment of the present invention, a lubricating device for an internal combustion engine is provided in which an oil tank chamber, defined by being separated from a crank chamber by a partition wall, is formed between a crankcase and a crankcase cover of the internal combustion engine. Oil pumped by a scavenge pump is supplied to a tank supply port which is open at an upper portion of the oil tank chamber. The oil stored in the oil tank chamber is sucked from a feed suction port which is open at a lower portion of the oil tank chamber to be supplied to respective regions for lubrication of the internal combustion engine by a feed pump, wherein an oil passage penetrating inside the oil tank chamber is formed below the tank supply port at an upper portion of the oil tank chamber.

An object of an embodiment of the present invention is to provide a lubricating device for an internal combustion engine wherein a relief valve is provided in order to return a part of the feed discharge oil to the feed suction oil passage when a discharge hydraulic pressure of the feed pump exceeds a predetermined value.

An object of an embodiment of the present invention is to provide the lubricating device for an internal combustion engine wherein the tank supply port is an opening formed in the crankcase and is directly coupled to a discharge port of the scavenge pump. The oil passage is a feed discharge oil passage formed integrally with the crankcase and is directly coupled to a discharge port of the feed pump.

An object of an embodiment of the present invention is to provide the lubricating device for an internal combustion engine wherein the tank supply port is formed above the oil passage while being adjacent thereto.

According to an embodiment of the present invention, the lubricating device for an internal combustion engine includes an oil passage that is formed and located below the tank supply port at an upper part of the oil tank chamber and which penetrates inside the oil tank chamber. Accordingly, bubbles which are mixed in an oil supplied by the scavenge pump to the tank supply port located at an upper portion of the oil tank chamber are prevented from traveling downward by the oil passage which is located below the tank supply port and which penetrates inside the oil tank chamber. Thus, air bleeding for the oil is prompted at an upper portion of the oil tank chamber. The bubbles are prevented from being mixed in the oil to be sucked from the feed suction port located at a lower portion of the oil tank chamber, so that cavitation of the feed pump can be reduced. Thus, the hydraulic pressure of the oil supplied to the respective regions for lubrication can be stabilized.

According to an embodiment of the present invention, when the discharge hydraulic pressure of the feed pump exceeds a predetermined value, the oil returned to the feed suction oil passage is sucked by the feed pump again because the relief valve for returning a part of the feed discharge oil to the feed suction oil passage is provided. Accordingly, the amount of oil sucked from the feed suction port can be reduced, and the suction flow rate can also be decreased, thus resulting in further reduction of cavitation of the feed pump.

According to an embodiment of the present invention, the tank supply port is directly coupled to the discharge port of the scavenge pump so as to be formed in the crankcase. The oil passage is also directly coupled to the discharge port of the feed pump so as to be formed integrally with the crankcase. Accordingly, the number of components of the internal combustion engine can be cut down, and the internal combustion engine can be reduced in size and weight.

According to an embodiment of the present invention, the tank supply port is formed above the oil passage while being adjacent thereto. Accordingly, bubbles which are mixed in oil supplied to the supply port for the tank can be effectively prevented from traveling downward by the adjacent oil passage, air bleeding for the oil can be further prompted, and cavitation of the feed pump can be further reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, an embodiment according to the present invention will be described on the basis of FIGS. 1 to 8.

Figure 1:
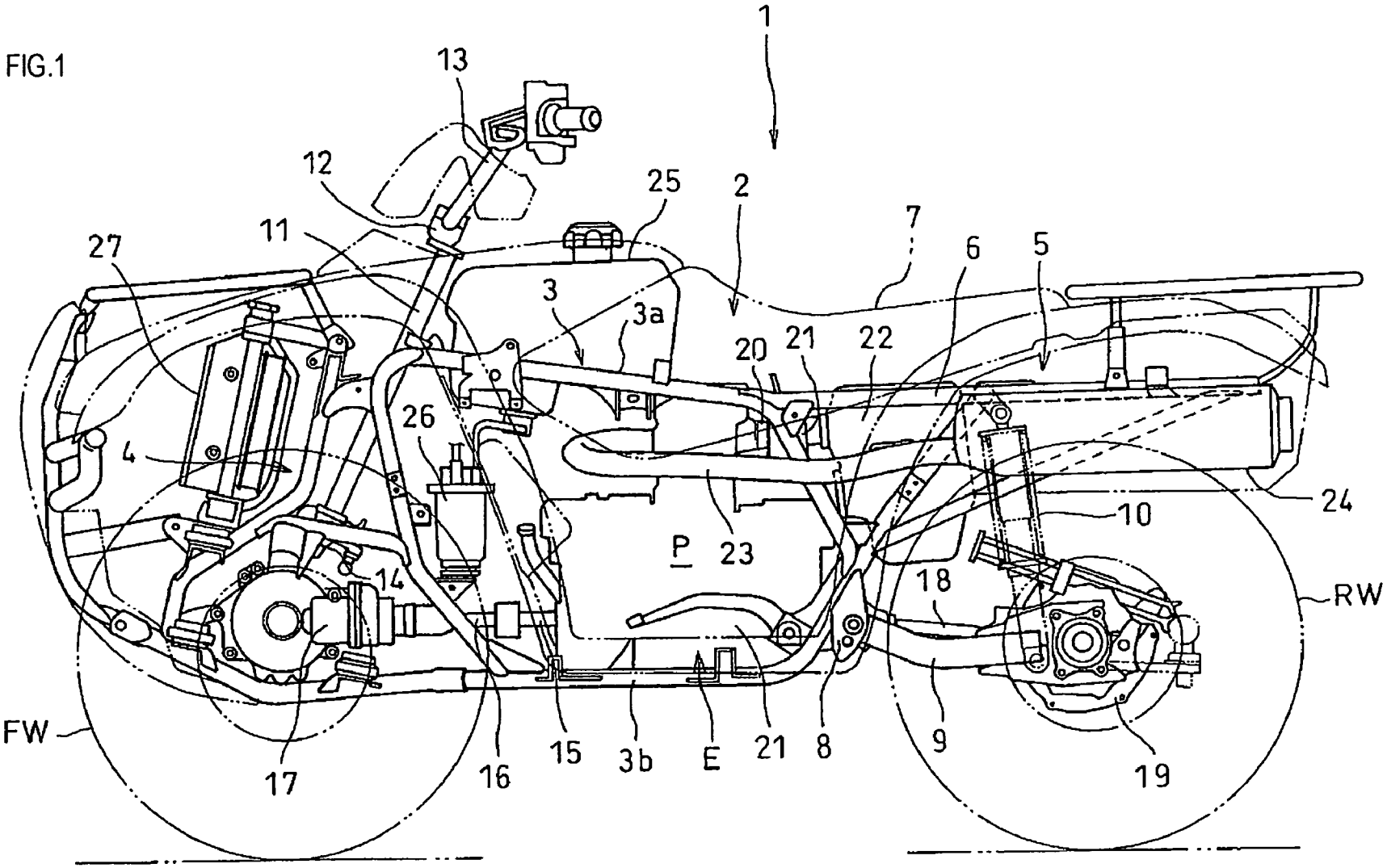
FIG. 1 is a side view of an all terrain vehicle, in which a power unit is mounted, according to an embodiment of the present invention in a state where a body cover and the like are dismounted.
Figure 2:
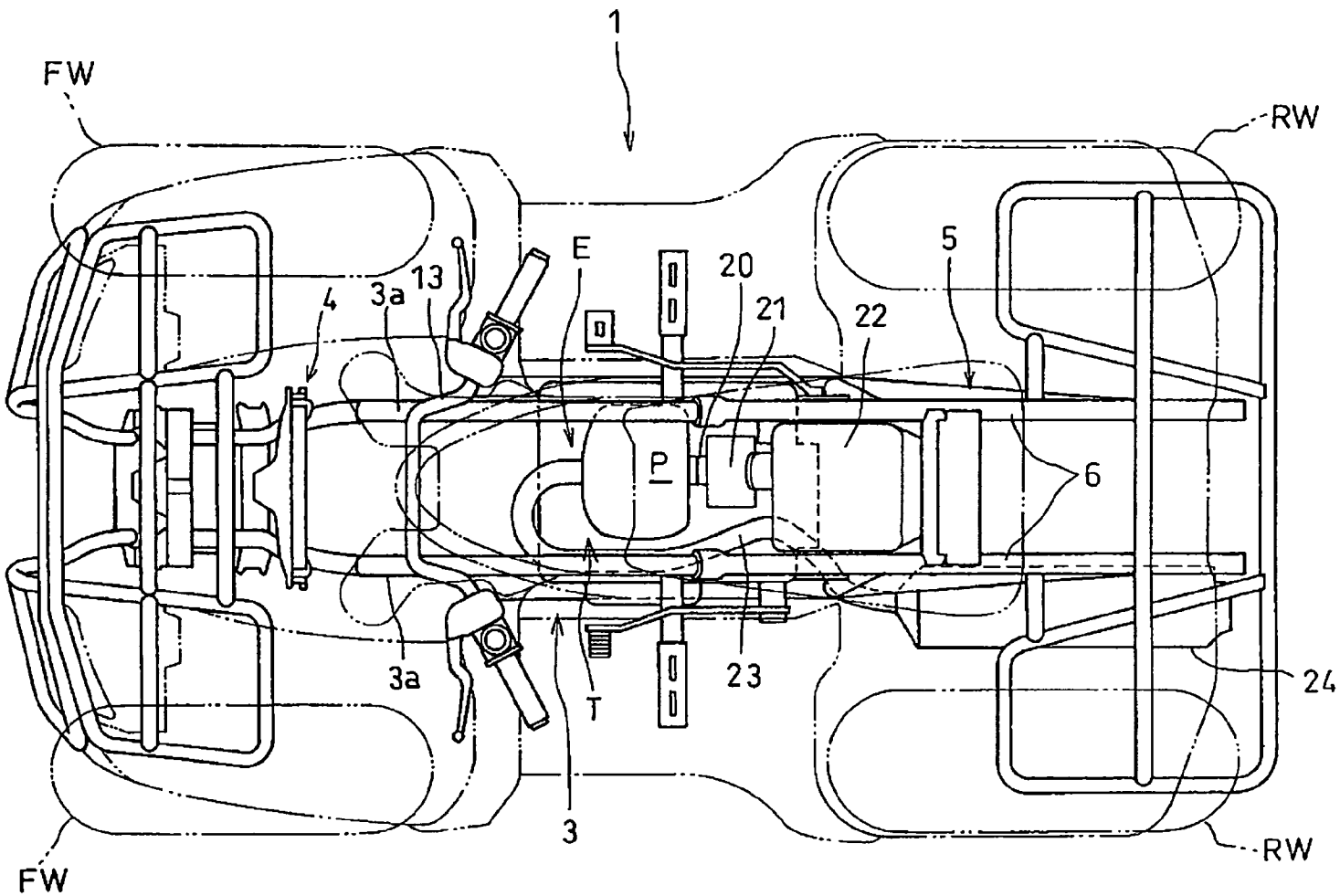
FIG. 2 is a plan view of the same.

FIG. 1 is a side view of an ATV (All Terrain Vehicle) 1, in which a water-cooled internal combustion engine E is mounted, according to an embodiment in a state where a body cover and the like are dismounted. FIG. 2 is a plan view of the same.

It should be noted that front, rear, left, and right directions of the vehicle are determined based on a state wherein the vehicle is directed in the forward direction in the embodiment.

The ATV 1 is a saddle-ride type four-wheeled vehicle in which a pair of left and right front wheels FW having low-pressure balloon tires for irregular terrain are mounted together with a pair of left and right rear wheels RW having the same kind of low-pressure balloon tires mounted that are suspended by a body frame 2 at its front and rear portions, respectively.

The body frame 2 is configured by coupling a plurality of kinds of steel materials to each other, and includes a center frame part 3 in which a power unit P that is integrally configured by an internal combustion engine E and a transmission T in a crankcase 31 is mounted. A front frame part 4 is continued to a front portion of the center frame part 3 to suspend the front wheels WF. A rear frame part 5 is continued to a rear portion of the center frame part 3 and includes seat rails 6 for supporting a seat 7.

The center frame part 3 forms a substantially rectangular shape when viewed from its sides in such a manner that front and rear portions of a pair of left and right upper pipes 3*a* are bent downward to form substantially three sides with the rest of one side being configured by a pair of left and right lower pipes 3*b*. Both left and right pipes are coupled to each other through a cross member.

A swing arm 9 is swingably provided to a pivot plate 8, while its front end is journalled thereto, which is fastened to extension portions formed by bending rear portions of the lower pipes 3*b* diagonally upward. A rear shock absorber 10 is interposed between a rear portion of the swing arm 9 and the rear frame part 5. The rear wheels RW are suspended by a rear final reduction gear unit 19 provided at a rear end of the swing arm 9.

A steering column 11 is supported by a cross member, in the middle of its width direction, which is provided between front ends of the left and right upper pipes 3*a*. A steering handlebar 13 is coupled to an upper end of a steering shaft 12 which is steerably supported by the steering column 11 with a lower end of the steering shaft 12 being coupled to a front wheel steering mechanism 14.

The internal combustion engine E of the power unit P is a water-cooled, single-cylinder, four-stroke internal combustion engine that is mounted in the center frame part 3 in such a manner that a crankshaft 30 is directed in the front-rear direction of the vehicle body. More specifically, the crankshaft 30 is vertically placed.

The transmission T of the power unit P is arranged in a transmission chamber M located on the left side (the right side in FIG. 3) of a crank chamber C to which the crankshaft 30 of the internal combustion engine E is journalled. An output shaft 15, that is directed in the front-rear direction, projects to the front and rear from the transmission M located nearer the left side. The rotational power of the output shaft 15 is transmitted to the left and right front wheels FW from a front end of the output shaft 15 through a front drive shaft 16 and a front final reduction gear unit 17, and is transmitted to the left and right rear wheels RW from a rear end of the output shaft 15 through a rear drive shaft 18 and the rear final reduction gear unit 19.

The internal combustion engine E is configured in such a manner that a cylinder block 32, a cylinder head 33, and a cylinder head cover 34 are sequentially laminated in the crankcase 31 so as to be provided in an erect manner while being slightly inclined to the left.

A suction pipe 20, which extends to the rear from the cylinder head 33, is connected to an air cleaner 22 through a throttle body 21. An exhaust pipe 23, which extends to the front from the cylinder head 33, is bent to the left to extend to the rear, and then extends rearward on the left side of the air cleaner 22 to be connected to an exhaust muffler 24.

A fuel tank 25 is supported, above the power unit P, by the center frame part 3 of the body frame 2 with a fuel pump 26 being arranged on the front lower side of the fuel tank 25, and a radiator 27 being supported by the front frame part 4 of the body frame 2.

The crankcase 31 configuring the crank chamber C and the transmission chamber M of the power unit P has a structure including a front crankcase 31F and a rear crankcase 31R which are divided into front and rear portions by a face orthogonal to the crankshaft 30 that passes through a center axis line of a cylinder bore of the cylinder block 32 and that is directed in the front-rear direction of the vehicle body.

Figure 3:
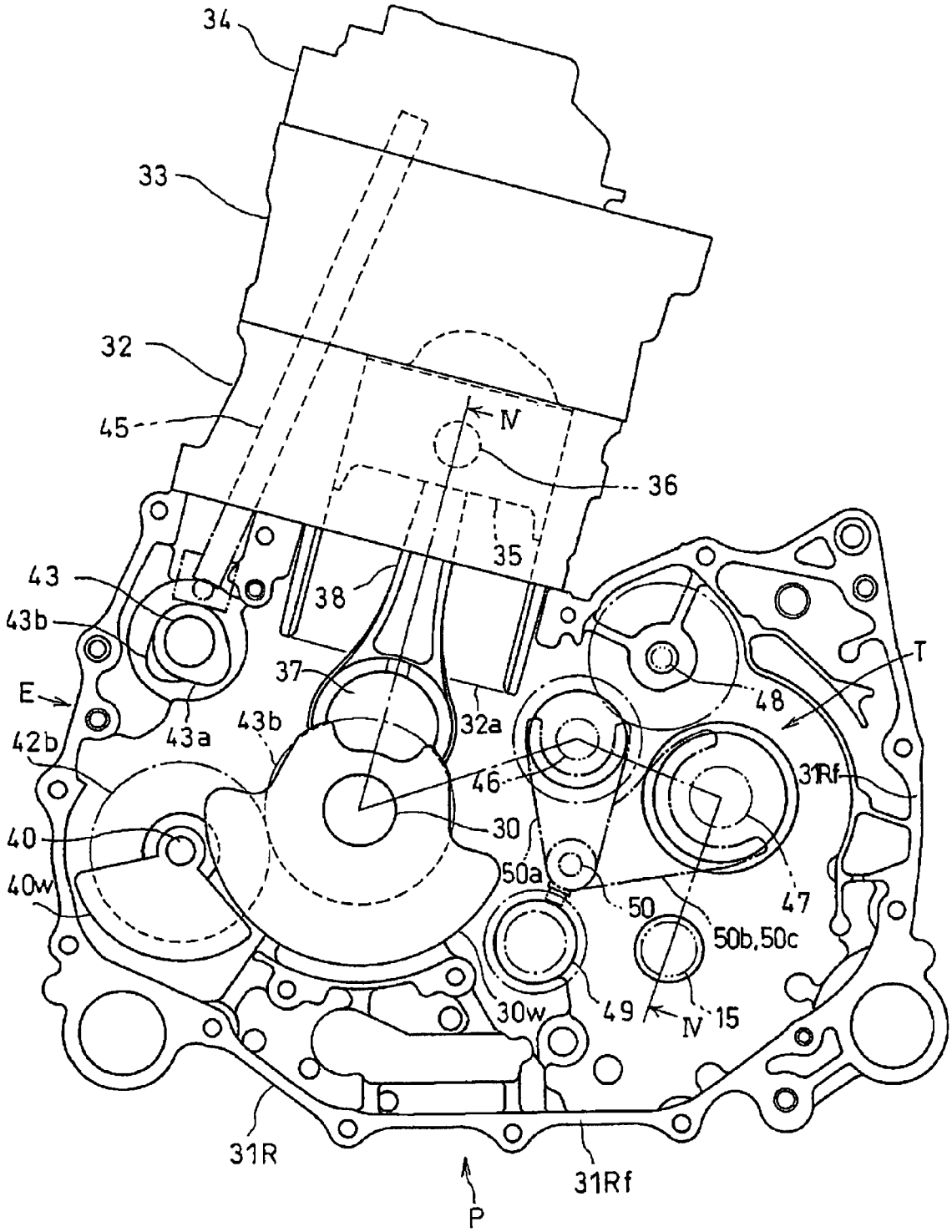
FIG. 3 is a front view of the power unit in which an internal combustion engine is partially omitted.

FIG. 3 is a front view of the power unit P illustrating a mating face 31Rf of the rear crankcase 31R while partially omitting the internal combustion engine E.

A cylinder sleeve 32*a* is fitted into the crankcase 31 from the cylinder block 32, and a piston 35 is swingably fitted into the cylinder sleeve 32*a*.

A crank pin 37, which is provided between a pair of front and rear crank webs 30*w* and 30*w* of the crankshaft 30, is coupled to a piston pin 36 provided in the piston 35 through a connecting rod 38.

Figure 4:
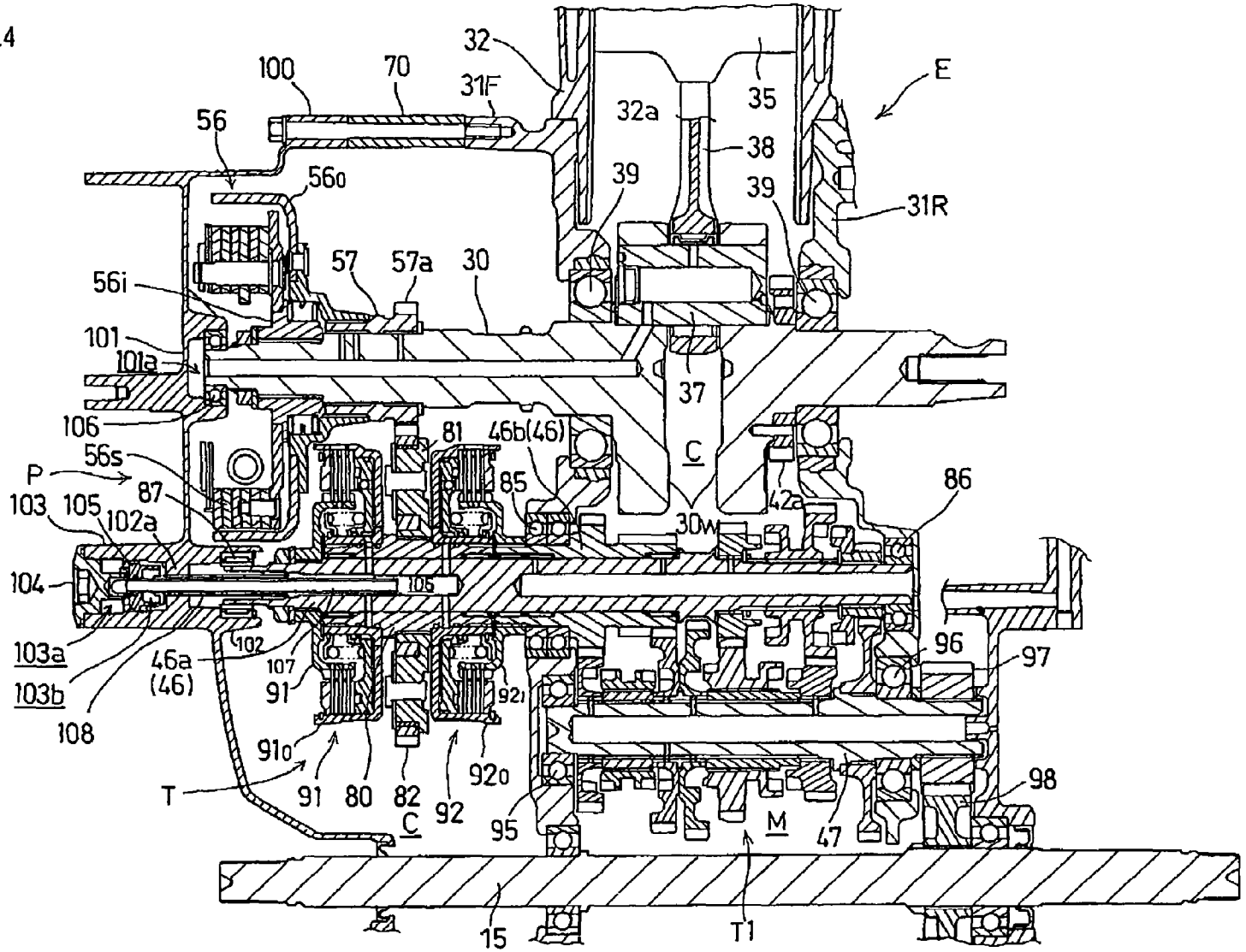
FIG. 4 is a cross sectional view of a power transmission mechanism.
Figure 5:
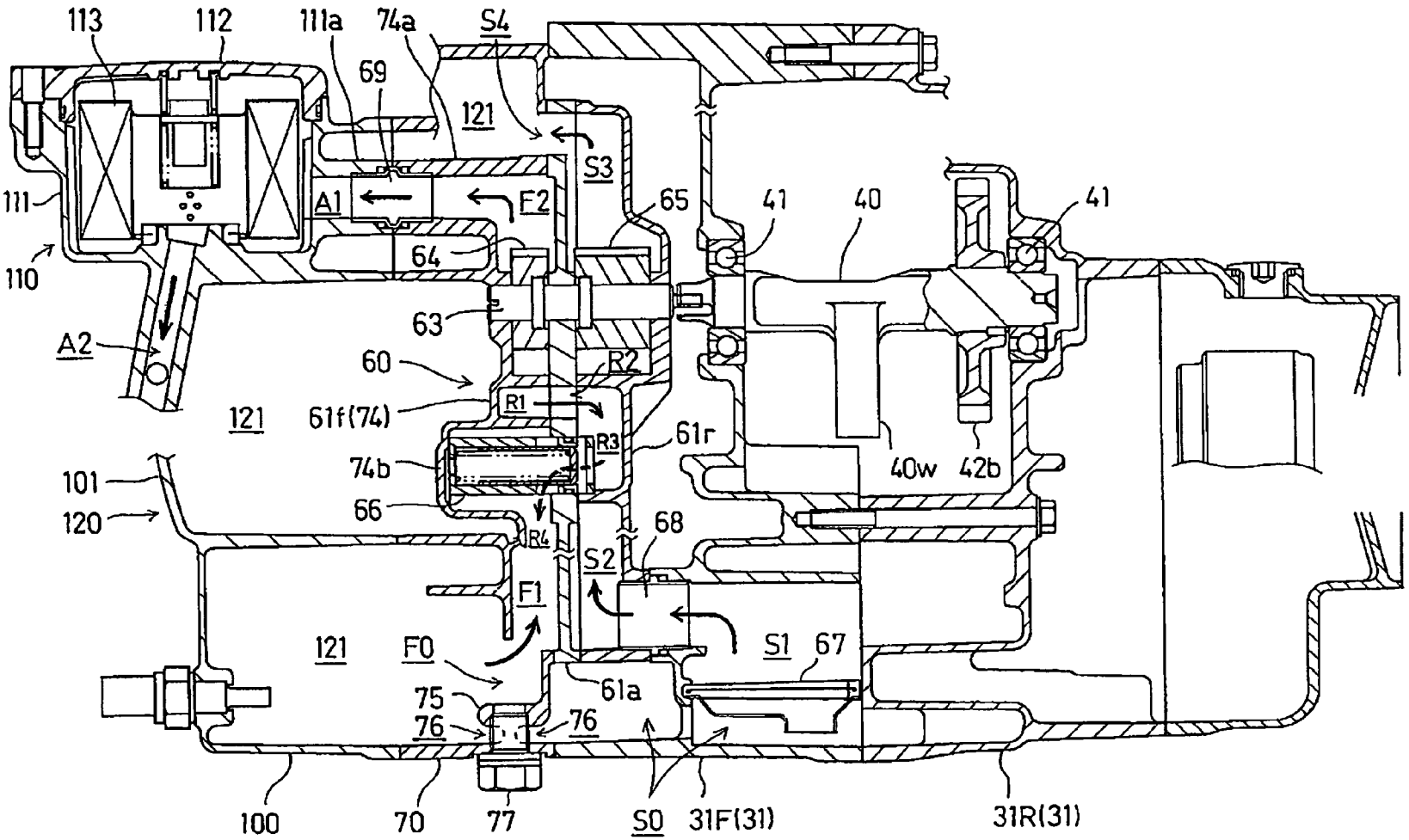
FIG. 5 is a cross sectional view taken along the line V-V of FIG. 6 and FIG. 7 of main components of a lubricating device.

FIG. 4 shows a cross-sectional view of a power transmission mechanism of the internal combustion engine E, and FIG. 5 is a cross-sectional view of the main components of a lubricating device.

As shown in FIG. 4, the crankshaft 30 is journalled to the front crankcase 31F and the rear crankcase 31R in front of and in rear of the crank webs 30*w* and 30*w* through main bearings 39 and 39.

A balancer shaft 40 which is parallel to the crankshaft 30 is located slightly below the right side (the left side in FIG. 3) of the crankshaft 30, and both ends of the balancer shaft 40 are journalled to the front crankcase 31F and the rear crankcase 31R through bearings 41 and 41, as shown in FIG. 5.

A balancer weight 40*w* is formed in the middle of the balancer shaft 40, and a driven gear 42*b* is fitted into a rear portion of the balancer shaft 40 so as to be meshed with a drive gear 42*a* (see FIG. 4) fitted into the crankshaft 30.

A cam shaft 43 of a valve system which is parallel to the crankshaft 30 is located diagonally above the right side of the crankshaft 30, and both ends of the cam shaft 43 are journalled to the front crankcase 31F and the rear crankcase 31R.

A lower end of a push rod 45 which transmits a drive power to a valve mechanism inside the cylinder head 33 abuts on cam lobes 43*a* and 43*b* of the cam shaft 43.

The transmission T is arranged on the left side (the right side in FIG. 3) of the crankshaft 30, and a main shaft 46, a counter shaft 47, and an intermediate shaft 48 configure a speed-change gear mechanism by which a shift drum 49 is driven for speed-change to transmit the changed speed to the output shaft 15.

With reference to FIG. 4, a centrifugal starting clutch 56 includes a clutch inner 56*i*, as an input member, which is rotated integrally with the crankshaft 30, a bowl-shape clutch outer 56*o*, as an output member, which encircles the clutch inner 56*i* outside in the diameter direction, and a clutch shoe 56*s*, as a centrifugal weight, which is pivoted by the clutch inner 56*i* and which is brought into contact with and connected to the clutch outer 56*o* by being swung outside in the diameter direction. A boss part of the clutch outer 56*o* is spline-fitted to a cylindrical gear member 57 which is rotatably journalled to the crankshaft 30.

A power is transmitted from a driven gear 57*a* of the cylindrical gear member 57 to the transmission T.

[0032]

The main shaft 46 of the transmission T is configured by a first main shaft 46*a* and a second main shaft 46*b* which is partially fitted into an outer circumference of the first main shaft 46*a* in a rotatable manner. The second main shaft 46*b* is journalled to the front crankcase 31F through a bearing 85, and a rear end of the first main shaft 46*a* is journalled to the rear crankcase 31R through a bearing 86.

[0033]

An input sleeve 80 provided side-by-side with the second main shaft 46*b* is rotatably fitted into the front side of the first main shaft 46*a*, a disk-shape disk plate 81 is fitted into a middle portion of the input sleeve 80, and a driven gear 82 provided on an outer circumference of the disk plate 81 is meshed with the drive gear 57*a*.

A first speed-change clutch 91 and a second speed-change clutch 92 are arranged ahead of and behind the disk plate 81, respectively.

[0034]

The first speed-change clutch 91 and the second speed-change clutch 92 are hydraulic multi-disk friction clutches with the same structure.

The first speed-change clutch 91 located on the front side is adjacent to the rear side of the starting clutch 56, and is configured in such a manner that a bowl-shape clutch outer 91*o* which is open to the front is integrally fitted into the front side of the input sleeve 80, and a clutch inner 91*i* is integrally fitted into the first main shaft 46*a*.

On the other hand, the second speed-change clutch 92 located on the rear side is configured in such a manner that a bowl-shape clutch outer 92*o*, which is open to the rear is integrally fitted into the rear side of the input sleeve 80, and a clutch inner 92*i*, is integrally fitted into a portion extending forward relative to the bearing 85 of the second main shaft 46*b*.

Accordingly, if the first speed-change clutch 91 is placed into an engaged state and the second speed-change clutch 92 is placed into a disengaged state, a power input to a driven gear 83 is transmitted to the first main shaft 46*a* through the first speed-change clutch 91. On the contrary, if the first speed-change clutch 91 is placed into a disengaged state and the second speed-change clutch 92 is placed into an engaged state, the power input to the driven gear 83 is transmitted to the second main shaft 46*b* through the second speed-change clutch 92.

Between the counter shaft 47 (and the intermediate shaft 48) which are arranged parallel to extension portions of the first main shaft 46*a* and the second main shaft 46*b* in the transmission chamber M and which are journalled through bearings 95 and 96, there is configured a speed change gear train group T1 which is an assembly of gear trains for setting a speed change gear.

The gear trains of the first main shaft 46*a* through a first speed-change clutch 251 configure speed change gears of the first-speed, third-speed and fifth-speed, and the gear trains of the second main shaft 46*b* through a second speed-change clutch 252 configure speed change gears of the second-speed, fourth-speed and the reverse.

A drive gear 97 is fitted into a rear end of the counter shaft 47 which extends to the rear from the rear crankcase 31R. A driven gear 98, which is fitted into the output shaft 15 arranged parallel to the counter shaft 47, is meshed with the drive gear 97, so that the power of a reduced speed is transmitted to the output shaft 15.

The shift drum 49 is rotatably provided between the front crankcase 31F and the rear crankcase 31R, and respective shift pins of shift forks 50*a*, 50*b*, and 50*c* which are swingably supported by a guide shaft 50 are fitted into shift grooves of three stripes formed on an outer circumferential face of the shift drum 49. The shift fork 50*a* which is guided by the shift groove by rotation of the shift drum 49 to be moved in the axis direction allows the gears on the main shaft 46 to be moved. In addition, the shift forks 50*b* and 50*c* allow the gears on the counter shaft 47 to be moved, so that a combination of speed change gears to be meshed are changed.

A rear mating face of the front crankcase 31F is combined with a front mating face 31Rf of the rear crankcase 31R shown in FIG. 3 so as to be tightened together. In addition, the crankcase 31 is configured by accommodating therein the crank web 30*w* of the crankshaft 30, the balancer weight 40*w* of the balancer shaft 40, the cam lobes 43*a* and 43*b* of the cam shaft 43, and the speed change gear train group T1.

The front side of the front crankcase 31F is covered with a front case cover 100 through a spacer 70.

The spacer 70 is an extension member formed in such a manner that a marginal portion of a front face of the front crankcase 31F is extends forwardly. In addition, an oil pump unit 60 of a dry sump lubrication system is configured in the spacer 70 and a part of an oil tank 120 is formed therein.

Figure 6:
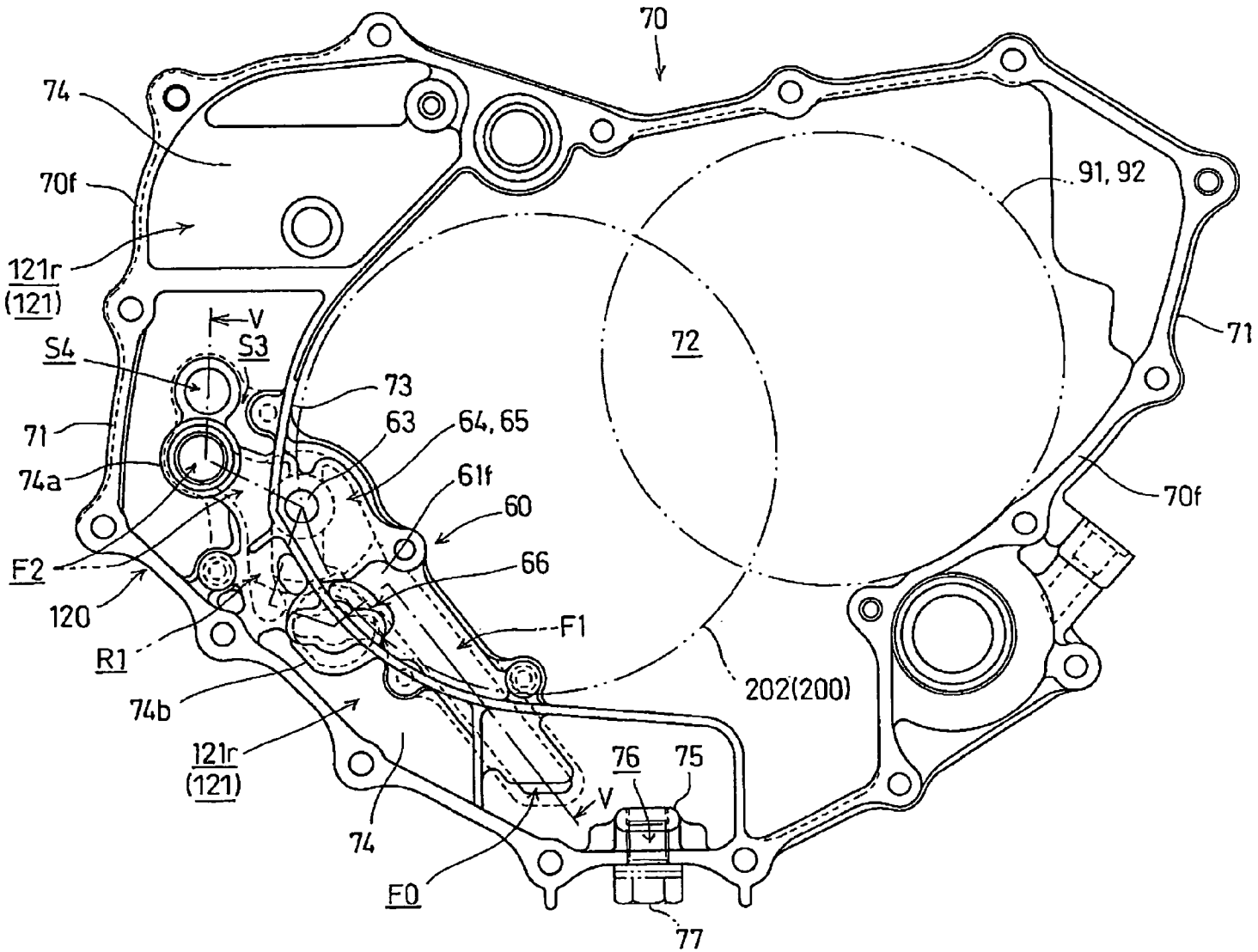
FIG. 6 is a front view of a spacer (an extension member of a crankcase)
Figure 7:
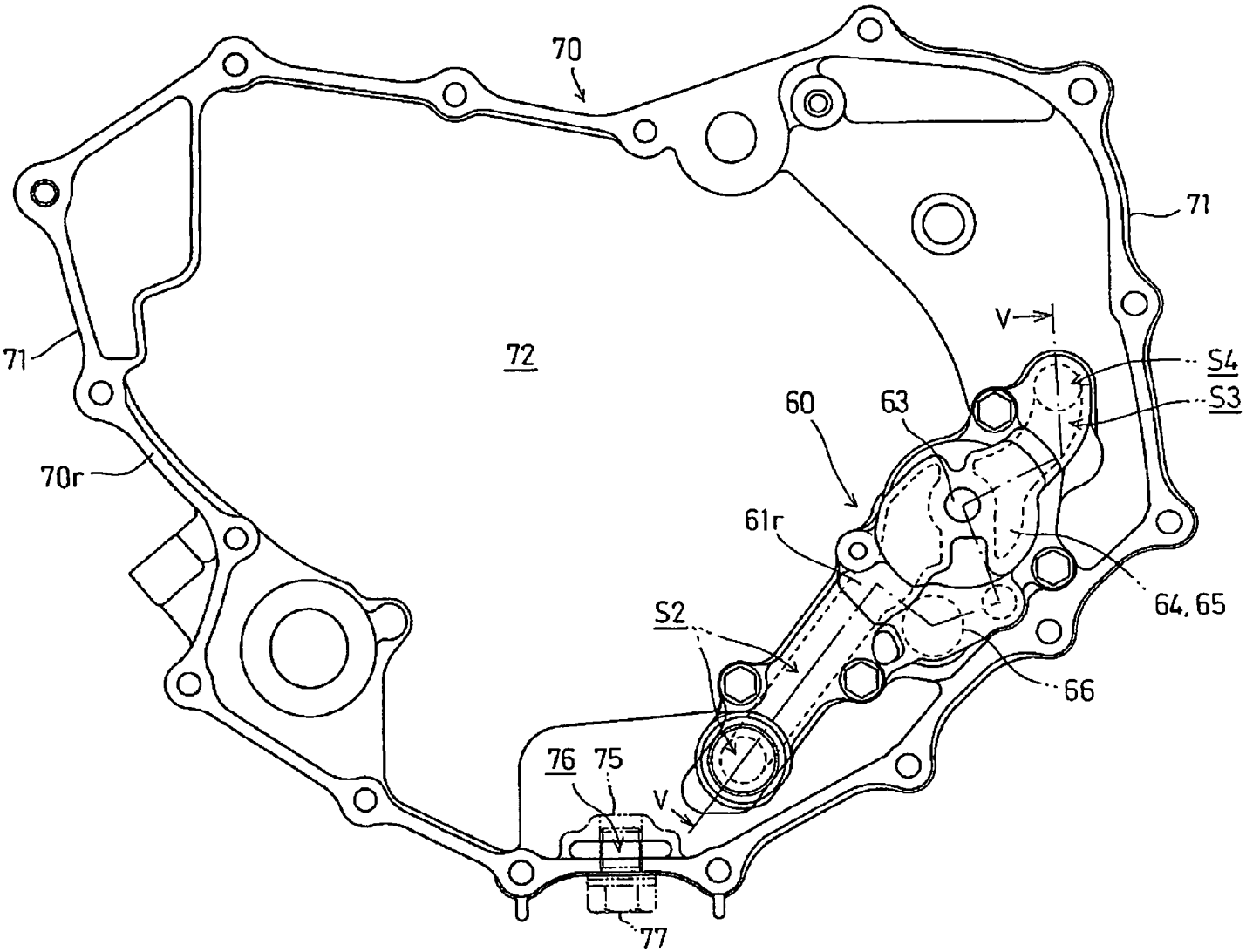
FIG. 7 is a rear view of the spacer.

FIG. 6 shows a front view of the spacer 70, and FIG. 7 is a rear view of the same.

The spacer 70 is used for linking the front crankcase 31F and the front case cover 100, and is a circular-shape member having front and rear mating faces 70*f* and 70*r* which are parallel to each other on a peripheral wall 71 and having a larger width in the left-right direction than that in the up-down direction. The inside of the peripheral wall 71 is partitioned by a circular arc-shape partition wall 73 along a bent right side portion (a left side portion in FIG. 6) of the peripheral wall 71, so that a large cavity 72 which is a part of the crank chamber C is defined on the left side (the right side in FIG. 6) of the partition wall 73.

A right side portion of the peripheral wall 71 and the partition wall 73 are coupled through a vertical wall 74. An elongated concave part 121*r* forms a rear portion of an oil tank chamber 121 in a circular arc-shape portion formed by being encircled by the peripheral wall 71, the partition wall 73, and the vertical wall 74 serving as a bottom wall.

The crankshaft 30 and the main shaft 46 penetrate the left-side cavity 72 which is substantially partitioned by the partition wall 73 of the spacer 70. The first speed-change clutch 251 and the second speed-change clutch 252 provided on the main shaft 46 are accommodated in the cavity 72. The partition wall 73 is formed in a circular arc-shape so as to be along a clutch outer 202 of a starting clutch 200 provided at a front end of the main shaft 46.

Thus, the elongated concave part 121*r* which forms a rear portion of the oil tank chamber 121 and which is located between the peripheral wall 71 and the partition wall 73 vertically extends with a circular arc shape from an upper portion of the peripheral wall 71 to a lowermost portion thereof while being separated from the cavity 72 (crank chamber C) by the partition wall 73.

Another circular arc-shape concave part is formed opposite to the elongated, circular arc-shape concave part 121*r* of the spacer 70 in the front case cover 100 with which the front side of the spacer 70 is covered. The oil tank chamber 121 is configured by coupling both circular arc-shape concave parts.

Oil inside the oil tank chamber 121 smoothly flows downward along inclined inner faces of outer peripheral walls of the circular arc-shape concave parts.

The vertical wall 74 projects to the cavity 72, and a part of the vertical wall 74 configures a front oil pump case 61*f* of the oil pump unit 60.

More specifically, on the right side of the spacer 70, the concave part 121*r* which is a rear portion of the oil tank chamber 121 is formed ahead of the vertical wall 74, and the front oil pump case 61*f* of the oil pump unit 60 is formed behind the vertical wall 74.

As shown in FIG. 5, the oil pump unit 60, formed in an inclined elongated shape, is configured in such a manner that a rear portion of the front oil pump case 61*f* is covered with a rear oil pump case 61*r* while sandwiching a partition wall 61*a*. The cases are tightened to bolts (see FIG. 7).

On the cavity 72-side along the partition wall 73 of the oil pump unit 60, a pump drive shaft 63 penetrates the front oil pump case 61*f*, the partition wall 61*a*, and the rear oil pump case 61*r* in the front-rear direction, is journalled coaxially with the balancer shaft 40. A rear end thereof further penetrates the front crankcase 31F to be coupled to the balancer shaft 40 while being integrally rotatable therewith (see FIG. 5).

As shown in FIG. 5, a feed pump 64 and a scavenge pump 65 are provided ahead of and behind the partition wall 61*a* of the pump drive shaft 63.

Between the rear oil pump case 61*r* and the partition wall 61*a*, an oil pumping passage S2 is formed in an extended manner diagonally below the scavenge pump 65. An oil supply passage S3 for tank is formed in an extended manner above the scavenge pump 65.

A lower end of the oil pumping passage S2 extending diagonally downwardly has an opening at its rear side, and is in communication with an oil pumping passage S1 located at a lower portion of the front crankcase 31F through a coupling pipe 68. An oil strainer 67 is interposed between the oil pumping passage S1 and an oil storage chamber S0 located therebelow.

The oil supply passage S3 for the tank extending upwardly is open at an upper end of the partition wall 61*a*, and is in communication with a supply port S4 for a tank of a corresponding portion of the vertical wall 74 (the bottom wall of the concave part 121*r* of the oil tank chamber 121) of the spacer 70.

The supply port S4 for tank is open at an upper portion of the oil tank chamber 121.

Thus, by driving the scavenge pump 65, oil stored in the oil storage chamber S0 corresponding to a bottom portion of the crank chamber C is pumped by passing through the oil pumping passages S1 and S2 via the oil strainer 67, and is discharged to the oil supply passage S3 for tank so as to be supplied from the supply port S4 for tank to the oil tank chamber 121.

The oil discharged from the scavenge pump 65 may be supplied from the supply port S4 for tank to the oil tank chamber 121 through, for example, auxiliaries such as an oil cooler.

On the other hand, between the front oil pump case 61*f* and the partition wall 61*a*, a feed suction oil passage F1 is formed in an extended manner diagonally below the feed pump 64. A feed discharge oil passage F2 is formed while being extended diagonally upwardly from a right portion of the feed pump 64.

A lower end of the feed suction oil passage F1 extending diagonally downwardly serves as a feed suction port F0 formed in the front oil pump case 61*f*, and is open at a lower portion of the oil tank chamber 121.

A cylindrical part 74*a* is formed below the supply port S4 for the tank while being adjacent thereto and while projecting forward from the vertical wall 74 (the bottom wall of the oil tank chamber 121). The feed discharge oil passage F2 extending diagonally upwardly is bent forward so as to be in communication with the cylindrical part 74*a*.

With reference to FIG. 5, a filter case of an oil filter 110 is formed on a right side wall of the front case cover 100 with which the front side of the spacer 70 is covered, and a cylindrical part 111*a* which forms an oil inflow passage A1 extending rearwardly from the filter case 111 is coupled to the cylindrical part 74*a* nearer the spacer 70 through a coupling pipe 69.

The cylindrical part 74*a* and the cylindrical part 111*a* coupled through the coupling pipe 69 penetrate inside the oil tank chamber 121 in the front-rear direction.

Below the feed pump 64, a relief valve 66 is fitted into a valve accommodation part 74*b* formed by swelling the vertical wall 74, and a rear end of the relief valve 66 penetrates the partition wall 61*a* to be fitted into a valve upstream chamber R3 defined in the rear oil pump case 61*r*.

A relief oil passage R1 which is formed by extending a part of the feed discharge oil passage F2 downwardly and the valve upstream chamber R3 are in communication with each other through a through-hole R2 formed by drilling a hole in the partition wall 61*a*.

A relief exit R4, formed in the valve accommodation part 74*b* on the valve downstream-side of the relief valve 66, is open to the feed suction oil passage F1.

Thus, by driving the feed pump 64, oil inside the oil tank chamber 121 is sucked by passing through the feed suction oil passage F1 from the feed suction port F0 which is open at a lower portion of the oil tank chamber 121, and is discharged to the feed discharge oil passage F2 to reach the oil filter 110 by passing through the oil inflow passage A1 inside the cylindrical parts 74*a* and 111*a* which penetrate inside the oil tank chamber 121 in the front-rear direction.

When a discharge hydraulic pressure of the feed pump 64 exceeds a predetermined value, the relief valve 66 is open, and a part of the discharged oil returns to the feed suction oil passage F1 from the feed discharge oil passage F2 through the relief oil passage R1, the valve upstream chamber R3, and the relief exit R4.

As shown in FIG. 6 and FIG. 7, the bottom wall of the spacer 70 is inclined downwardly from the left and right sides toward the middle, and a bolt boss part 75 is formed, while swelling in the oil tank chamber 121, on the bottom wall at the lowermost position in the middle. A bolt hole to which a drain bolt 77 is fastened by screwing from the lower side is vertically provided in the bolt boss part 75, and a drain hole 76 penetrates the bolt boss part 75 in the front-rear direction so as to intersect with the bolt hole, and a bottom portion of the oil tank chamber 121 is accordingly in communication with the oil storage chamber S0 of a bottom portion of the crank chamber C (see FIG. 5).

Thus, when the drain bolt 77 is fastened to the bolt boss part 75 by screwing from the lower side of the spacer 70, the bottom wall can be closed while partitioning between a bottom portion of the oil tank chamber 121 and a bottom portion of the crank chamber C. When the drain bolt 77 is unscrewed, oil can be simultaneously drained from the both of the oil tank chamber 121 and the crank chamber C.

In the front case cover 100 with which the front side of the spacer 70 is covered, a front wall 101 inside a circular-shape mating face opposite to the front mating face 70*f* of the spacer 70 is formed while being swelled forward. On the right side of the front case cover 100, the circular arc-shape concave part configuring the oil tank chamber 121 is formed as described above, and the starting clutch 56, the first speed-change clutch 91, and the like are accommodated in a swelled space except the circular arc-shape concave part (see FIG. 4).

As shown in FIG. 4, on the front wall 101 of the front case cover 100, a bearing hole 101*a* to which a front end of the crankshaft 30 is journalled through a bearing 106, and a bearing cylindrical part 102 to which a front end of the first main shaft 46*a* is journalled through a bearing 87 are formed while projecting to the inner side.

The inside of an outer cylindrical part 103 formed by extending the bearing cylindrical part 102 outwardly and the inside of the bearing cylindrical part 102 are partitioned by a division wall 102*a*, an opening of a front end of the outer cylindrical part 103 is closed by a lid member 104, and the inner space is partitioned into a front chamber 103*a* and a rear chamber 103*b* by a partition member 105.

On the other hand, a shaft hole 106 is provided from a front end of the first main shaft 46*a* to a position corresponding to the second speed-change clutch 92 by drilling a hole in a front portion of the first main shaft 46*a*. A long conduction inner pipe 107 which penetrates the partition member 105 from the front chamber 103*a* to be inserted into the shaft hole 106 is arranged so as to reach an intermediate position between the first speed-change clutch 91 and the second speed-change clutch 92. A rear end thereof is supported by the shaft hole 106 by using a seal member 107*a*.

A short conduction outer pipe 108 which is coaxially arranged around the outer circumference of the long conduction inner pipe 107 is inserted into the shaft hole 106 with a front end thereof fitted into the division wall 102*a*. A rear end thereof is supported by the shaft hole 106 by using a seal member 108*a*.

To each of the front chamber 103*a* and the rear chamber 103*b* of the outer cylindrical part 103, hydraulic pressure is supplied from a hydraulic pressure control valve unit 160.

When hydraulic pressure is supplied to the rear chamber 103*b*, the pressured oil passes between the short conduction outer pipe 108 and the conduction inner pipe 107, and is supplied to the first speed-change clutch 91 from the front of the seal member 107*a* so as to allow the first speed-change clutch 91 to be in an engaged state.

When hydraulic pressure is supplied to the front chamber 103*a*, the pressurized oil passes through the long conduction inner pipe 107, and is supplied to the second speed-change clutch 92 from the shaft hole 106 located rearwardly relative to the seal member 107*a* so as to allow the second speed-change clutch 92 to be in an engaged state.

The speed change gears of the first-speed, third-speed and fifth-speed of the gear trains of the first main shaft 46*a* through the first speed-change clutch 91, and the speed change gears of the second-speed, fourth-speed and the reverse of the gear trains of the second main shaft 46*b* through the second speed-change clutch 252 are alternately shifted by the control of the hydraulic pressure control valve unit 160. Thus, a speed change is smoothly performed.

As shown in FIG. 5, the oil filter 110 is configured in such a manner that a filter element 113 is inserted into the filter case 111 formed on a right side wall of the front case cover 100, and the filter case 111 is covered with the filter cover 112 from the right side.

Oil discharged from the feed pump 64 flows in from the oil inflow passage A1 extending rearwardly behind the filter case 111, and an oil outflow passage A2 extends to the left along the front wall 101 of the front case cover 100 from the middle of a bottom wall of the filter case 111.

Figure 8:
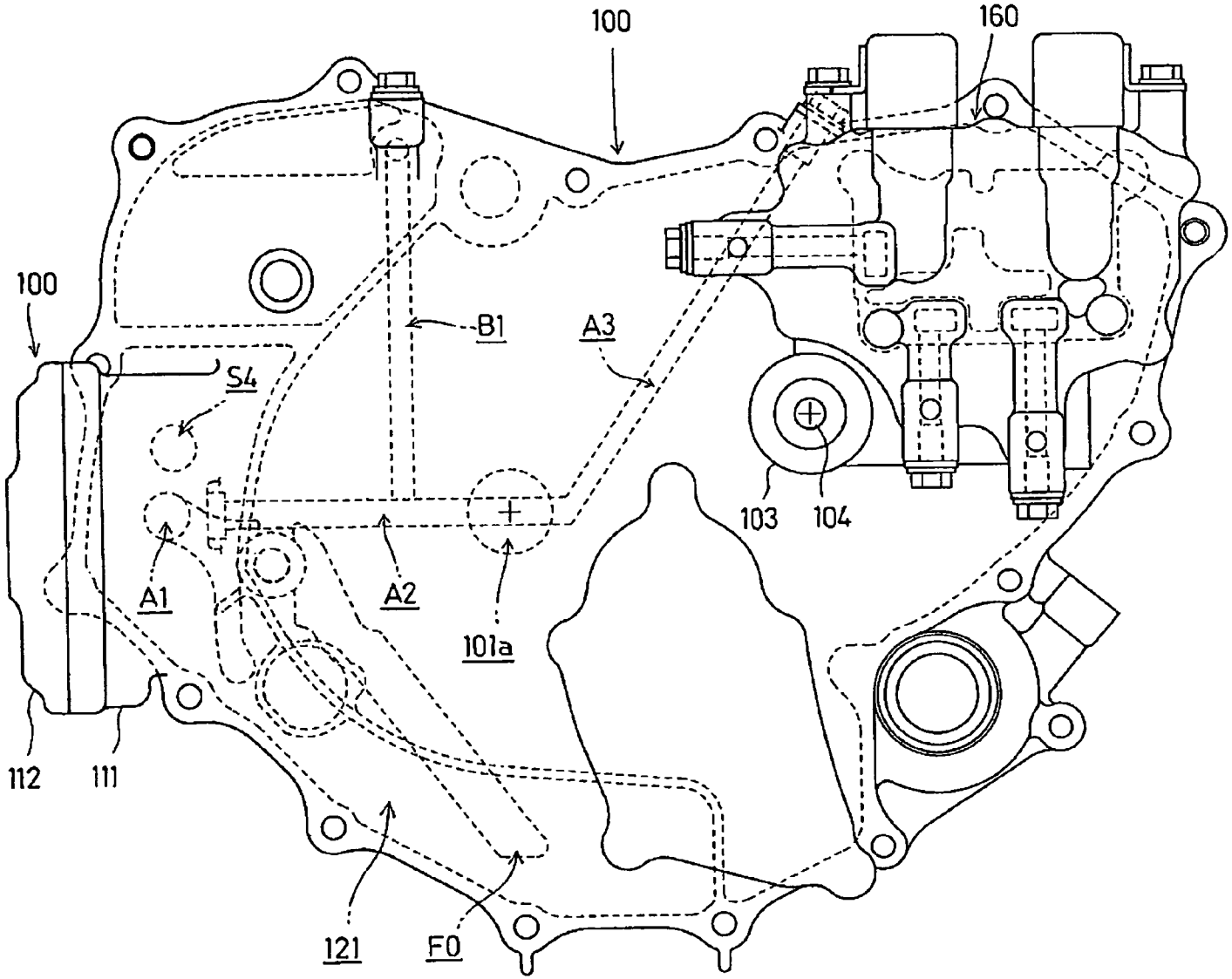
FIG. 8 is a front view of a front case cover.

As shown in FIG. 8, the oil outflow passage A2 is in communication with the bearing hole 101*a* of the front wall 101 to which a front end of the crankshaft 30 is journalled through the bearing 106 for allowing the bearing 106 to be lubricated. Further, an oil supply passage A3 which is continued to the oil outflow passage A2 extends diagonally upwardly from the bearing hole 101*a*, and is in communication with the hydraulic pressure control valve unit 160 arranged on the left upper side of the front wall 101 so as to supply oil.

In addition, an oil supply passage B1 is branched from the mid-course of the oil outflow passage A2, and extends upwardly to supply oil to the cylinder head 32.

The hydraulic pressure control valve unit 160 is adjacent to the outer cylindrical part 103 and coaxial with the bearing cylindrical part 102 to which the main shaft 46 having thereon the first and second speed-change clutches 91 and 92 provided is journalled for controlling hydraulic pressure to be supplied to the front chamber 103*a* and the rear chamber 103*b* of the outer cylindrical part 103 which controls engagement/disengagement of the first and second speed-change clutches 91 and 92.

As described above, in the lubricating device of the internal combustion engine E, the feed discharge oil passage F2 of the cylindrical part 74*a* is formed which is located below the supply port S4 for the tank while being adjacent thereto at an upper part of the oil tank chamber 121 and which penetrates inside the oil tank chamber 121. Accordingly, bubbles which are mixed in oil supplied by the scavenge pump 65 to the supply port S4 for the tank located at an upper portion of the oil tank chamber 121 are prevented from traveling downward by the feed discharge oil passage F2 which is located below the supply port S4 for the tank while being adjacent thereto and which penetrates inside the oil tank chamber. Air bleeding for the oil is prompted at an upper portion of the oil tank chamber 121. Thus, bubbles are prevented from being mixed in the oil to be sucked from the feed suction port F0 located at a lower portion of the oil tank chamber 121, so that cavitation of the feed pump 64 can be reduced, and the hydraulic pressure of the oil supplied to the respective regions for lubrication can be stabilized.

When the discharge hydraulic pressure of the feed pump 64 exceeds a predetermined value, the oil returned to the feed suction oil passage F1 is sucked by the feed pump 64 again because the relief valve 66 for returning a part of the feed discharge oil to the feed suction oil passage F1 is provided. Accordingly, the amount of oil sucked from the feed suction port F0 can be reduced, and the suction flow rate can be also decreased, thus resulting in a further reduction of cavitation of the feed pump.

The supply port S4 for the tank is directly coupled to the discharge port of the scavenge pump 65, and is formed in the spacer 70 which is an extension member of the crankcase 31. The feed discharge oil passage F2 is also directly coupled to the discharge port of the feed pump 64 so as to be formed integrally with the spacer 70. Accordingly, the number of components of the internal combustion engine E can be cut down, and the internal combustion engine E can be reduced in size and weight.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating device for an internal combustion engine comprising:

an oil tank chamber defined by being separated from a crank chamber by a partition wall, said oil tank chamber being formed between a crankcase and a crankcase cover of the internal combustion engine wherein oil pumped by a scavenge pump is supplied to a tank supply port which is open at an upper portion of the oil tank chamber and oil stored in the oil tank chamber is sucked from a feed suction port which is open at a lower portion of the oil tank chamber to be supplied to respective regions for lubrication of the internal combustion engine by a feed pump;

wherein an oil passage penetrating inside the oil tank chamber is formed below the tank supply port at an upper portion of the oil tank chamber.

2. The lubricating device for an internal combustion engine according to claim 1, wherein a relief valve is provided in order to return a part of feed discharge oil to a feed suction oil passage when discharge hydraulic pressure of the feed pump exceeds a predetermined value.

3. The lubricating device for an internal combustion engine according to claim 1, wherein the tank supply port is an opening formed in the crankcase and is directly coupled to a discharge port of the scavenge pump; and the oil passage is a feed discharge oil passage formed integrally with the crankcase and is directly coupled to a discharge port of the feed pump.

4. The lubricating device for an internal combustion engine according to claim 2, wherein the tank supply port is an opening formed in the crankcase and is directly coupled to a discharge port of the scavenge pump; and the oil passage is a feed discharge oil passage formed integrally with the crankcase and is directly coupled to a discharge port of the feed pump.

5. The lubricating device for an internal combustion engine according to claim 1, wherein the tank supply port is formed above the oil passage while being adjacent thereto.

6. The lubricating device for an internal combustion engine according to claim 2, wherein the tank supply port is formed above the oil passage while being adjacent thereto.

7. The lubricating device for an internal combustion engine according to claim 3, wherein the tank supply port is formed above the oil passage while being adjacent thereto.

8. The lubricating device for an internal combustion engine according to claim 1, wherein the scavenge pump and the feed pump are arranged on a pump drive shaft that is journalled coaxially with a balancer shaft.

9. A lubricating device adapted for use with an internal combustion engine comprising:

an oil tank chamber defined by being separated from a crank chamber by a partition wall, said oil tank chamber being formed between a crankcase and a crankcase cover of the internal combustion engine;

a scavenge pump operatively connected to the oil tank chamber wherein oil pumped by the scavenge pump is supplied to a tank supply port which is open at an upper portion of the oil tank chamber; and a feed pump operatively connected to the oil tank chamber wherein oil stored in the oil tank chamber is sucked from a feed suction port which is open at a lower portion of the oil tank chamber to be supplied to respective regions for lubrication of the internal combustion engine;

wherein an oil passage penetrating inside the oil tank chamber is formed below the tank supply port at an upper portion of the oil tank chamber.

10. The lubricating device adapted for use with an internal combustion engine according to claim 9, wherein a relief valve is provided in order to return a part of feed discharge oil to a feed suction oil passage when discharge hydraulic pressure of the feed pump exceeds a predetermined value.

11. The lubricating device adapted for use with an internal combustion engine according to claim 9, wherein the tank supply port is an opening formed in the crankcase and is directly coupled to a discharge port of the scavenge pump; and the oil passage is a feed discharge oil passage formed integrally with the crankcase and is directly coupled to a discharge port of the feed pump.

12. The lubricating device adapted for use with an internal combustion engine according to claim 10, wherein the tank supply port is an opening formed in the crankcase and is directly coupled to a discharge port of the scavenge pump; and the oil passage is a feed discharge oil passage formed integrally with the crankcase and is directly coupled to a discharge port of the feed pump.

13. The lubricating device adapted for use with an internal combustion engine according to claim 9, wherein the tank supply port is formed above the oil passage while being adjacent thereto.

14. The lubricating device adapted for use with an internal combustion engine according to claim 10, wherein the tank supply port is formed above the oil passage while being adjacent thereto.

15. The lubricating device adapted for use with an internal combustion engine according to claim 11, wherein the tank supply port is formed above the oil passage while being adjacent thereto.

16. The lubricating device adapted for use with an internal combustion engine according to claim 9, wherein the scavenge pump and the feed pump are arranged on a pump drive shaft that is journalled coaxially with a balancer shaft.

17. A lubricating device adapted for use with an internal combustion engine comprising:

an oil tank chamber defined by being separated from a crank chamber by a partition wall;

a supply port formed in an upper portion of the oil tank chamber;

a scavenge pump operatively connected to the oil tank chamber wherein oil pumped by the scavenge pump is supplied to the tank supply port to the oil tank chamber;

a feed suction port formed in a lower portion of the oil tank chamber; and a feed pump operatively connected to the oil tank chamber wherein oil stored in the oil tank chamber is sucked from the feed suction port to be supplied to respective regions for lubrication of the internal combustion engine;

wherein an oil passage penetrating inside the oil tank chamber is formed below the tank supply port at an upper portion of the oil tank chamber.

18. The lubricating device adapted for use with an internal combustion engine according to claim 17, wherein a relief valve is provided in order to return a part of feed discharge oil to a feed suction oil passage when discharge hydraulic pressure of the feed pump exceeds a predetermined value.

19. The lubricating device adapted for use with an internal combustion engine according to claim 17, wherein the tank supply port is an opening formed in a crankcase and is directly coupled to a discharge port of the scavenge pump; and the oil passage is a feed discharge oil passage formed integrally with the crankcase and is directly coupled to a discharge port of the feed pump.

20. The lubricating device adapted for use with an internal combustion engine according to claim 17, wherein the scavenge pump and the feed pump are arranged on a pump drive shaft that is journalled coaxially with a balancer shaft.

* * * * *